US009302143B2

(12) United States Patent
Kyriacos

(10) Patent No.: US 9,302,143 B2
(45) Date of Patent: Apr. 5, 2016

(54) EXERCISE DEVICE FOR TORSO ROTATION AND METHOD OF OPERATING THE SAME

(75) Inventor: Mark Zachary Kyriacos, Frankford, DE (US)

(73) Assignee: CHESED DIRECT HOLDINGS LTD., Ramsey Isle of Man (GB)

( * ) Notice: Subject to any disclaimer, the term of this patent is extended or adjusted under 35 U.S.C. 154(b) by 685 days.

(21) Appl. No.: 13/520,308

(22) PCT Filed: Jan. 4, 2011

(86) PCT No.: PCT/US2011/020150
§ 371 (c)(1), (2), (4) Date: Mar. 30, 2013

(87) PCT Pub. No.: WO2011/082434
PCT Pub. Date: Jul. 7, 2011

(65) Prior Publication Data

US 2013/0184130 A1 Jul. 18, 2013

Related U.S. Application Data

(60) Provisional application No. 61/291,931, filed on Jan. 4, 2010.

(51) Int. Cl.
*A63B 21/22* (2006.01)
*A63B 21/02* (2006.01)
(Continued)

(52) U.S. Cl.
CPC ..... *A63B 21/15* (2013.01); *A63B 21/0552* (2013.01); *A63B 21/1492* (2013.01); *A63B 23/0227* (2013.01); *A63B 21/0081* (2013.01); *A63B 21/023* (2013.01);
(Continued)

(58) Field of Classification Search
CPC ..... A63B 21/1492; A63B 23/0211; A63B 2023/003
USPC ..... 482/51, 110, 121–123, 126–140, 142, 482/910
See application file for complete search history.

(56) References Cited

U.S. PATENT DOCUMENTS 5,094,449 A * 3/1992 Stearns ..... 482/130
5,244,446 A * 9/1993 Engel et al. ..... 482/137
(Continued)

FOREIGN PATENT DOCUMENTS

JP 2003210610 A * 7/2003
WO WO 2004078268 A2 * 9/2004

OTHER PUBLICATIONS

PCT Search report of PCT/US2011/020150, Mailed Oct. 18, 2011.
(Continued)

*Primary Examiner* — Joshua Lee
(74) *Attorney, Agent, or Firm* — Marc Van Dyke; Fourth Dimension IP

(57) ABSTRACT

Embodiments of the disclosed subject matter relate to an exercise device for torso rotations. The device includes a rotating assembly including an inclined, elevated, backwardly-oriented back rest and optionally a head rest and an arm assembly. The rotating assembly is configured to a effect a side-to-side rotation around a pivot point elevated above a base of the device and around an axis oriented along the device. When the user leans weight his upper back on the back rest to elevate his/her upper back, s/he may effect torso rotations that, in some embodiments, are resisted by a resistance assembly of the exercise device.

4 Claims, 21 Drawing Sheets

(51) Int. Cl.

| | |
|---|---|
| ***A63B 21/04*** | (2006.01) |
| ***A63B 21/00*** | (2006.01) |
| ***A63B 21/055*** | (2006.01) |
| *A63B 21/06* | (2006.01) |
| *A63B 23/02* | (2006.01) |
| *A63B 23/00* | (2006.01) |
| *A63B 71/06* | (2006.01) |
| *A63B 21/16* | (2006.01) |
| *A63B 21/008* | (2006.01) |

(52) U.S. Cl.

CPC ..... *A63B 21/0421* (2013.01); *A63B 21/0555* (2013.01); *A63B 21/0557* (2013.01); *A63B 21/0615* (2013.01); *A63B 23/0211* (2013.01); *A63B 23/0233* (2013.01); *A63B 71/0622* (2013.01); *A63B 2021/1609* (2013.01); *A63B 2023/003* (2013.01); *A63B 2208/0233* (2013.01); *A63B 2210/50* (2013.01)

(56) References Cited

U.S. PATENT DOCUMENTS

| | | | | |
|---|---|---|---|---|
| 5,609,566 | A * | 3/1997 | Pupovic | 601/23 |
| 6,113,522 | A * | 9/2000 | Fontenot et al. | 482/111 |
| 7,297,095 | B2 * | 11/2007 | Zachary | 482/142 |
| 7,507,191 | B2 | 3/2009 | Zachary | |
| 7,641,596 | B2 * | 1/2010 | Sharps | 482/51 |
| D649,205 | S | 11/2011 | Zachary | |
| 2004/0185991 | A1 * | 9/2004 | Bowman et al. | 482/140 |
| 2006/0166799 | A1 * | 7/2006 | Boland et al. | 482/140 |
| 2007/0037663 | A1 * | 2/2007 | Goel et al. | 482/1 |
| 2007/0298946 | A1 * | 12/2007 | Zachary | 482/136 |
| 2010/0173761 | A1 * | 7/2010 | Zachary | 482/142 |
| 2012/0015777 | A1 * | 1/2012 | Goel et al. | 482/4 |

OTHER PUBLICATIONS

PCT Search opinion of PCT/US2011/020150, Mailed Oct. 18, 2011.

* cited by examiner

Folding
Sequence
Of Images
Frame 1/3

Folding
Sequence
Of Images
Frame 2/3

Folding
Sequence
Of Images
Frame 3/3

EXERCISE DEVICE FOR TORSO ROTATION AND METHOD OF OPERATING THE SAME

CROSS-REFERENCE TO RELATED APPLICATIONS

This patent application claims the benefit of U.S. Provisional Patent Application No. 61/291,931 filed on Jan. 4, 2010 and incorporated herein by reference in its entirety.

FIELD AND BACKGROUND ART

Embodiments of the present invention relate to an abdominal exercise machine and a method of using the same.

The following documents are believed represent the state of the art and are all incorporated herein by reference in their entirety: U.S. Pat. No. 7,507,191 and U.S. Pat. No. 7,297,095.

SUMMARY OF EMBODIMENTS

Embodiments of the present invention relate to an exercise device for torso rotation.

When the user is laying down and facing up so that the user's lower back is substantially flat on the floor (or any other surface—e.g. a surface substantially at floor-height rather than an elevated surface), the user may rest the upper part of his/her body on an inclined rotatable body support surface (e.g. back support) of the exercise device. This body support surface elevates the user's upper back to maintain the user in an inclined position. While in this position, the user may effect torso rotations by causing the body support surface of the exercise device to effect a 'side-to-side' rotation around a pivot point elevated above the user's lower back or buttocks and around an axis that is along the length of the exercise device. In some embodiments, a resistance assembly provides resistance to these torso rotations that induce side-to-side rotation of the inclined back-support surface of the exercise device.

In some embodiments, the exercise machine includes a base portion and a rotating assembly including one or more inclined body support surfaces. By leaning some of his/her body weight on the rotatable body support surface(s) (e.g. including a back rest and/or head rest) and by causing the rotating assembly to rotate in a 'side-to-side' motion relative to a base of the device (e.g. which is stationary during rotation), the user may, in some embodiments, work the oblique muscles of the core and/or the rectus abdominus and erector spinae.

This side-to-side rotational motion may be carried out around a rotation axis substantially parallel to the user's spine and/or around a rotation axis that is substantially parallel to an 'posterior-anterior' vector of the exercise device.

In some embodiments, the device is constructed so that the rotating assembly including the body support surface(s) for supporting the user's upper back rotates around a pivot point 180 that is elevated above a base portion 146 of the exercise device and/or above a location on the back rest 124 surface (e.g. a centroid of back rest surface 124 or any other location of back rest surface 124) and/or above a position where user's back is resting—e.g. elevated by at least 5 cm or 10 cm or 15 cm or 20 cm or 25 cm.

In some embodiments, the pivot point 180 is elevated above the base portion 146 of the exercise device and/or above a location on the back rest 124 surface (e.g. a centroid of back rest surface 124 or any other location of back rest surface 124) and/or above a position where user's back is resting by at most 50 cm or at most 40 cm or at most 30 cm or at most 25 cm or at most 20 cm or at most 15 cm.

In some embodiments, the rotating assembly includes portions that are elevated above the base of the device (e.g. which remains stationary during the side-to-side rotation). The rotating assembly effects the side-to-side rotation around a pivot point which is elevated above the based of the device and/or the surface on which the user lays the lower portion of his/her back and/or the lower portion of his/her body.

In some embodiments, the exercise machine includes a resistance assembly configured to resist the rotational motion. In some embodiments, the amount of resistance provided by the user depends on the orientation of the body-support surface(s).

For example, when the rotational assembly including the one or more body support surface(s) is oriented in the middle position (i.e. when the body supporting surface(s) points neither to the left or the right) no resistance or a minimal amount of resistance to rotational motion (i.e. to the left or the right) is provided. In some embodiments, the further the rotational assembly of the device rotates to the left or right, the greater the 'restoring force' acting to restore the device to its 'equilibrium' middle position.

Methods for operating the device and for folding the device for storage are also disclosed herein.

It is now disclosed an exercise device comprising: a) a base assembly including a lower base portion defining a base plane (e.g. substantially planar and/or horizontal base portion) and a substantially vertical portion; b) a rotating assembly configured to effect a side-to-side rigid-body rotation relative to the base assembly (e.g. rigid base assembly) around a rotation axis that is substantially parallel to a posterior-anterior vector and around a pivot point that is elevated above the base plane, the rotating assembly including an elevated, inclined back rest or back rest surface that is elevated above the base portion, the back rest surface or an upper surface of the back rest being inclined so as to face in a backwards direction towards a posterior oriented end of the exercise device; and c) a resistance assembly configured to provide resistance to the side-to-side-rotation.

In some embodiments, the pivot point is above a centroid of the back support or back support surface.

In some embodiments, the resistance assembly is configured to provide a variable resistance to side-to-side rigid body rotation whose strength depends on an orientation of the rotating assembly.

In some embodiments, the resistance assembly is configured to provide a variable resistance to side-to-side rigid body rotation whose strength increases as an orientation of the rotating assembly further deviates from a central or equilibrium orientation.

In some embodiments, the rotating assembly further includes a head rest located above the back rest configured to effect side-to-side rotation in tandem with the back rest.

In some embodiments, the pivot point is above a center of the back rest and below a center of the head rest.

In some embodiments, the back rest is adjustable.

In some embodiments, a plane of the back rest surface or of an upper surface of the back rest is angled at least 10 degrees below a horizon and/or at least 10 degrees below a plane parallel to the base plane device by the horizontal base portion.

In some embodiments, the rotating assembly further includes an arm assembly of left arms and right arms.

In some embodiments, the left and right arms of the arm assembly are separate from each other.

In some embodiments, the left and right arms are integrally formed with each other.

In some embodiments, each of the left and right arms include and elongated upward portion pointing above the base plane to substantially form an upwards V structure.

In some embodiments, the left and right arms are bent.

In some embodiments, the rotating assembly is mounted to the base assembly at a pivot point that is located below the head rest and above the back rest.

In some embodiments, the rotating assembly is mounted to the base assembly at a pivot point that is located below the head rest and above the back rest.

In some embodiments, the arms are configured to provide an inward folding degree of freedom.

In some embodiments, the arms are outwardly biased away from each other.

In some embodiments, further comprising left and right arm stops for limiting the extent to which the arms may be drawn to each other.

In some embodiments, a ratio between: i) a height of a centroid of the headrest above the base plane; and ii) a height of a centroid of the backrest above the base plane is at least 1.5:1.

In some embodiments, the substantially vertical portion of the base assembly includes a downwards V portion.

In some embodiments, the device is foldable to reversibly collapsed the downwards V portion.

In some embodiments, the device is foldable.

In some embodiments, the device is foldable so that for the combination of the head rest, the back rest, and the base assembly, a volume ratio V1/V2 between: i) a volume V1 occupied by the smallest circumscribing rectangular prism of the combination of the head rest, the back rest and the base assembly when the device is in an operating configuration; and i) a volume V2 occupied by the smallest circumscribing rectangular prism of the combination of the head rest, the back rest and the base assembly when the device is in an folded configuration is at least 1.5 or at least 2 or at least 4.

In some embodiments, the resistance assembly includes at least one of a resisting elastic element and a rotatable weight.

It is now disclosed a method of effecting a rotary torso exercise by a portable exercise device, the method comprising: a) at a time that the user is in laying down and facing up and when the user's buttocks and/or lower back is located substantially at floor level, placing a user's upper back on a backrest of the exercise device to elevate the user's upper back and head; b) effecting a torso rotation by the user so as to force the elevated back rest of the device to effect a side-to-side rotation around a rotation axis that is substantially parallel to a posterior-anterior vector of the exercise device and that passes though a pivot point that is elevated above the user's lower back; and c) providing resistance by the exercise device to the torso rotation.

In some embodiments the resistance is provide by a weight and/or rubber band assembly.

In some embodiments, the resistance is a variable resistance that depends on an orientation of the backrest or back support surface.

In some embodiments, the pivot point is elevated above the user's lower back by at least 5 cm.

In some embodiments, the pivot point is elevated above the user's lower back by at least 10 cm or at least 15 cm and/or at most 40 cm or at most 30 cm or at most 20 cm.

BRIEF DESCRIPTION OF THE DRAWINGS

FIGS. 6B-8 are frame/image sequence providing diagrams of an exercise machine during a machine folding routine.

DETAILED DESCRIPTION OF EMBODIMENTS

Embodiments of the present invention relate to an abdominal exercise machine for conditioning the oblique muscles of the core and/or the rectus abdominus and erector spinae.

Some embodiments relate to a portable exercise device which may be operated when user is laying down on the floor (or another surface), facing upwards (e.g. in a so-called zero-gravity position), when the lower portion of the user's body is substantially flat on the floor. A body support surface(s) including an inclined elevated back rest portion that is oriented upwards and in the backwards direction (i.e. towards the posterior of the user and/or towards the 'posterior oriented end 420—see FIGS. 1E-1F) holds an upper portion of the user's body in an elevated position The user's body is maintained in an inclined position due to the back rest.

Leaning a portion of his/her body weight on the back rest surface, the user rotates from 'side-to-side' by causing a rotational assembly of the exercise machine including the back support to effect the side-to-side rotation. This rotational assembly, which may rotate relative to a stationary base portion, may include an elevated body rest surface (s) including a back rest, one or more arm pieces, In some embodiments, the device is configured so that the torso rotations are carried out when the user is leaning upper back on the back rest and is in the so-called 'zero gravity' position.

In some embodiments, the rotational assembly may rotate around a pivot point that is elevated above the base assembly and/or above the location on which the user's lower back is resting.

In some embodiments, rather than providing a constant resistance to side-to-side rotational motion, the resistance may be variable. In one example, the further the rotational assembly deviates from an equilibrium 'mid-position' (e.g. facing directly upwards), the greater the amount of resistance to motion away from the equilibrium mid-position.

Thus, in some embodiments, the rotating assembly is configured to provide a bias towards the 'mid-position' orientation.

Figure 1A:
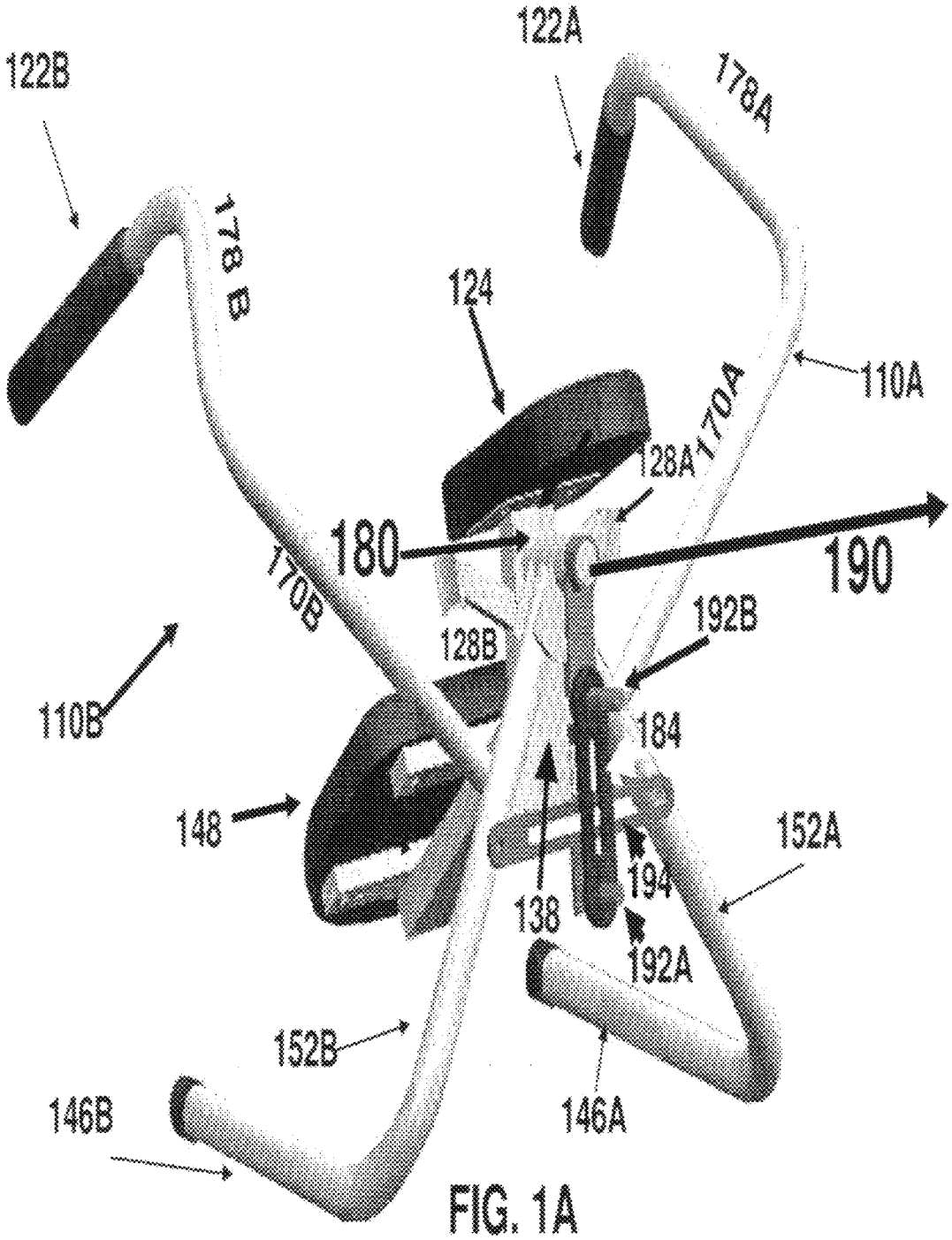
FIGS. 1A-1B are back views of an exercise machine device according to some embodiments.
Figure 1B:
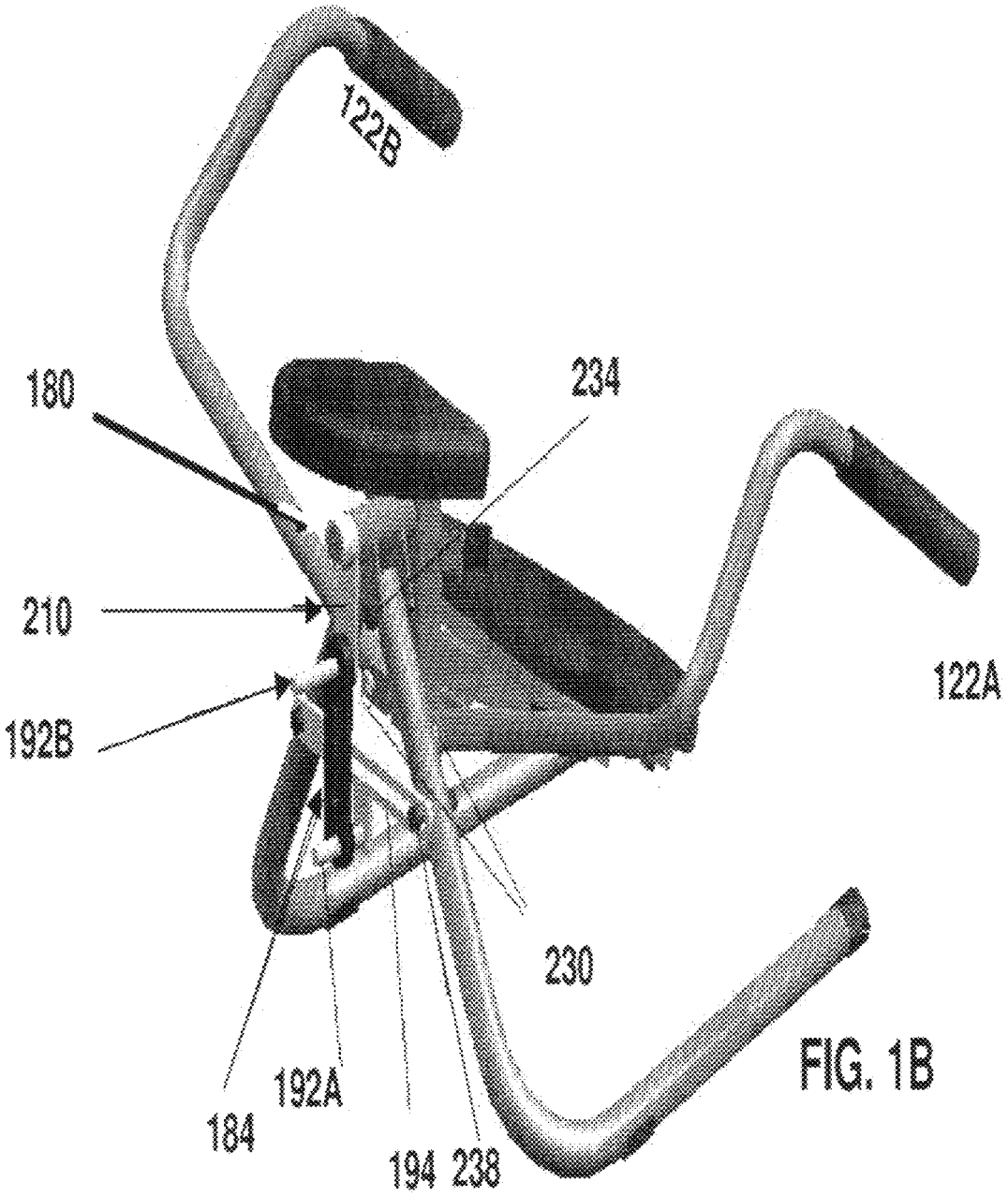

FIGS. 1A-1B are front views of a rotary torso exercise device in according with some embodiments. The exercise device of FIGS. 1A-1B includes: (i) a base assembly which may be placed on the floor; and (ii) a rotating assembly which may rotate, relative to the base assembly around rotation axis 190 as the user (laying on his/her back facing upwards) rotates his/her torso around a rotation axis substantially parallel to his/her spine. It is appreciated that the illustrated rotation axis 190 is a geometric construct and does not represent any physical part.

Figure 11:
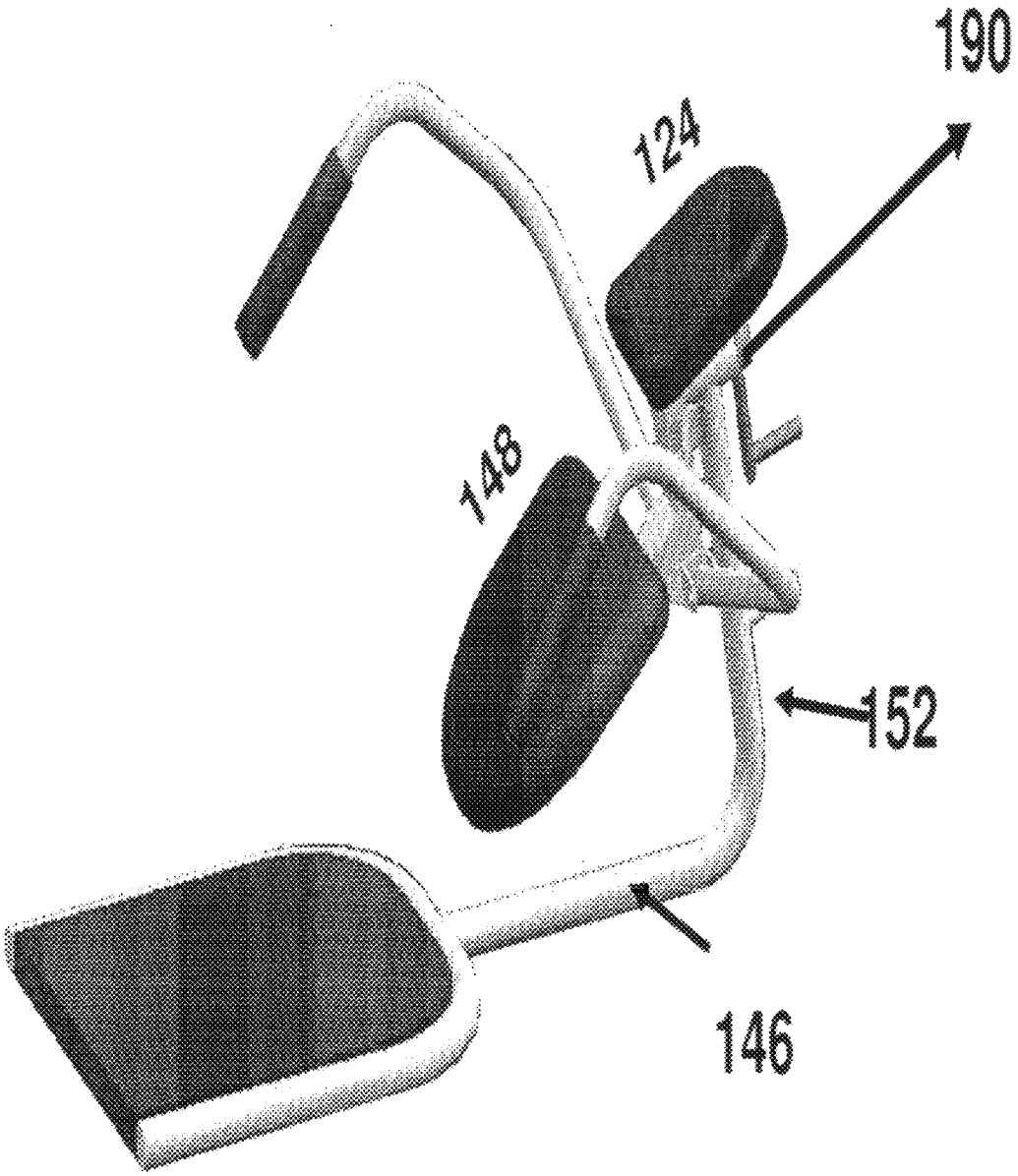
FIG. 11 is a diagram of a 'non-folding' machine.
Figure 12:
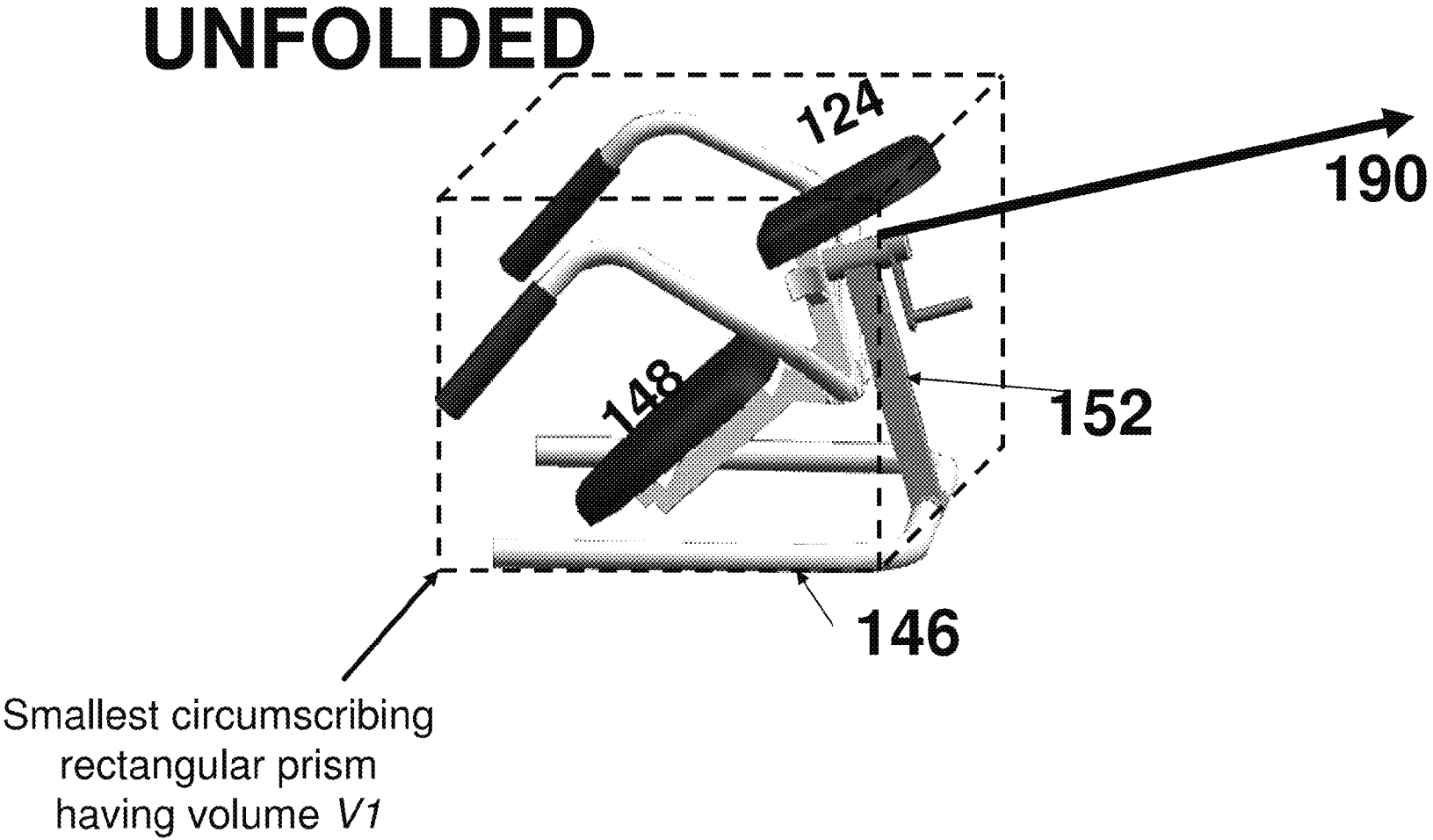
FIG. 12-13 are diagrams of a machine whereby the base assembly includes a single main vertical member in the unfolded (FIG. 12) and folded (FIG. 13) configurations.
Figure 13:
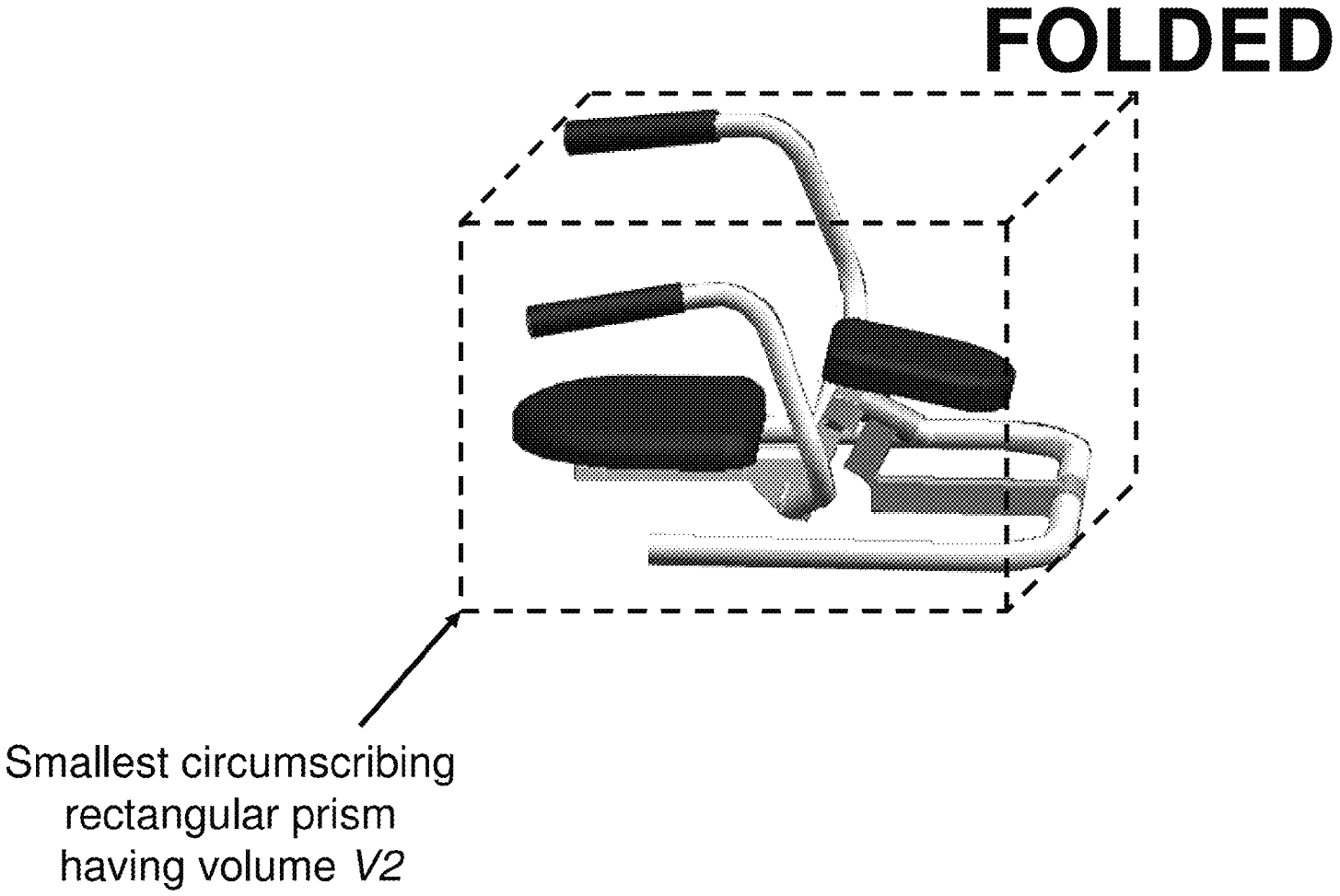

The base assembly of FIGS. 1A-1B includes: a substantially horizontal base portion defining a base plane and a substantially vertical portion. In the non-limiting example of FIGS. 1A-1B, (i) the horizontal base portion includes two elongated substantially horizontal base rods 146A, 146B that are substantially parallel to each other, and (ii) the substantially vertical portion includes two substantially vertical rods 152A,152B. It is appreciated (see FIGS. 11-12) that there is no requirement of two horizontal or vertical rods. In the non-limiting example of FIGS. 1A-1B, the two substantially vertical rods 152A,152 are configured in a "downwardly points" or "upside down" V configuration and stabilized by horizontal stabilizing element 194 which may provide outward force on rods 152A,152B to stabilize the upside down V structure. As will be discussed below (see FIGS. 6-8), horizontal stabilizing element 194 may be reconfigured, during folding, to allow the collapse of the upside-down V configuration. Thus, as explained with reference to FIGS. 6A, 7-8 horizontal support element 194 may be at least partially detached from vertical element 152A by disengaging fastener 238 allowing horizontal support element 194 to "slide" to facilitate folding of the machine.

The rotating assembly of FIGS. 1A-1B includes: (i) left 110A and right 110B bent arms; (ii) headrest 124; and (iii) backrest 148. In some embodiments, headrest and backrest may be rigidly fixed relative to each other during rotation. As illustrated in FIGS. 1A-1B, backrest 148 is angled downwards (i.e. in the direction away from the headrest—this is the direction from the user's head to his/her buttocks).

In the non-limiting example of FIGS. 1A-1B, the base assembly and the rotating assembly may rotate relative to each other, and are attached to each other at a pivot point 180, around which the rotating assembly (including left 110A and right 110B bent arms; (ii) headrest 124; and (iii) backrest 148) may rotate.

As is illustrated in FIGS. 1A-1B, the rotating assembly including body rest surface (including back rest 148 and the head rest 124) rotates around pivot point 180—thus, rotation vector 190 is illustrated to leave from pivot point 180.

Pivot point 180 is clearly elevated above the plane of the base assembly—for example, by at least 5 cm or at least 10 cm or at least 15 cm or at least 20 cm or any other value.

In some embodiments, the pivot point 180 is located below (i.e. at a lower height than, or, in some embodiment, directly below) headrest. As is illustrated in FIGS. 1A-1B, pivot point 180 is located above (i.e. at a higher height) than backrest 148.

Figure 3:
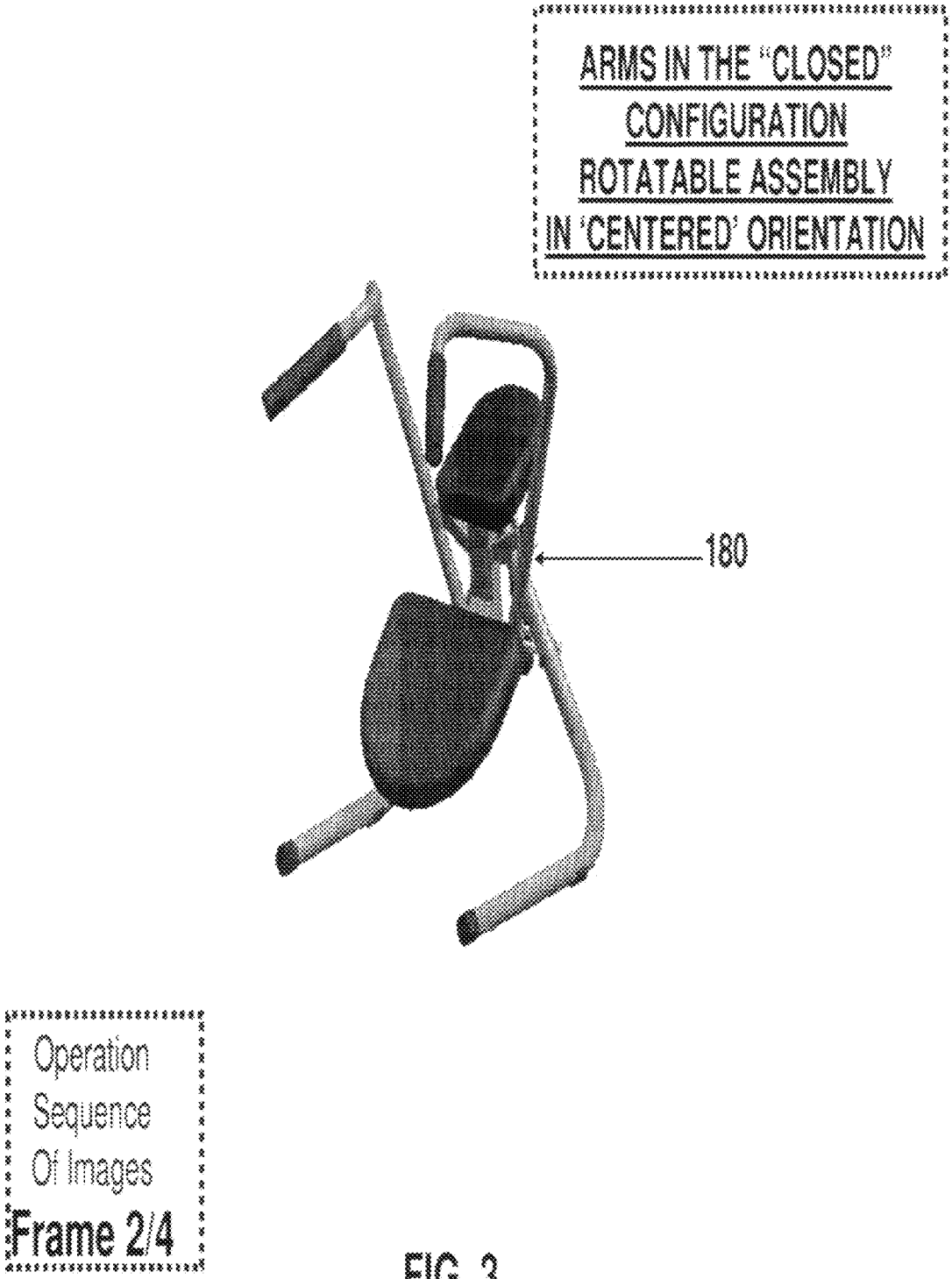
Figure 4:
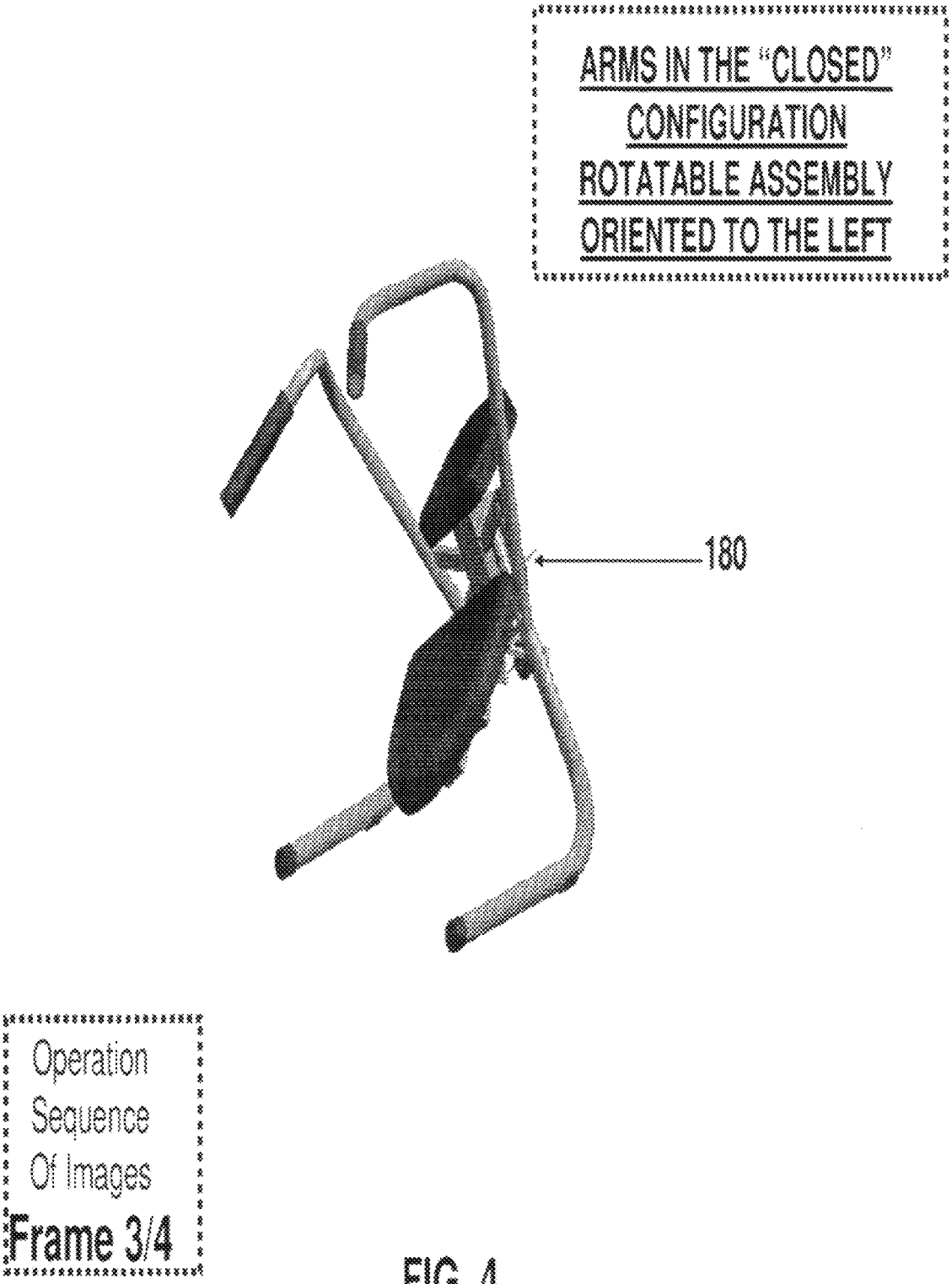
Figure 5:
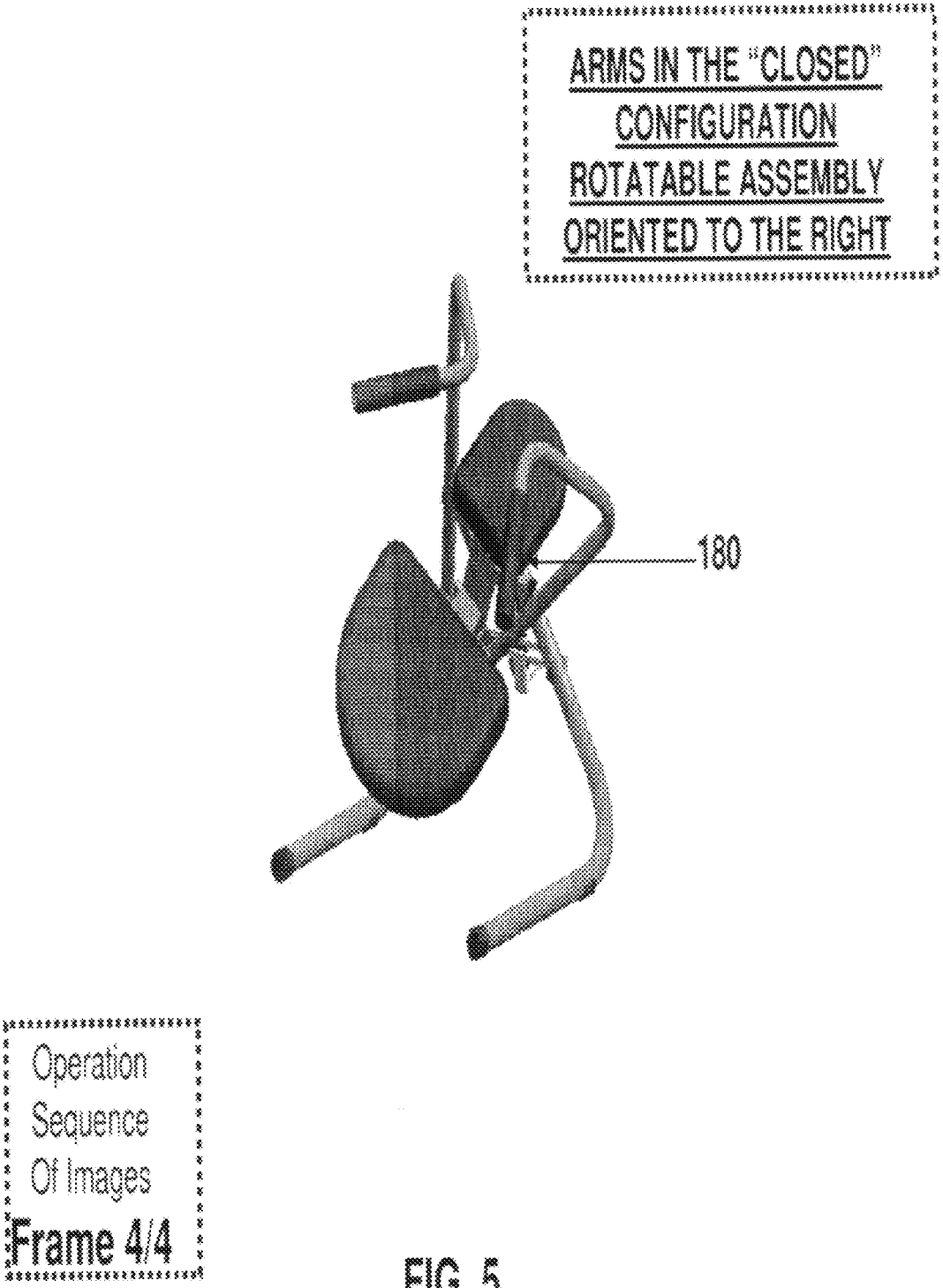

The following parts of rotating assembly may rotate around pivot point 180 and axis 190 while base assembly remains fixed: (i) bent arms 110A and 110B; (ii) backrest 148; (iii) headrest 124; (iv) central rotating part 138 (also referred to as the "main shaft") which facilitates rigid connection between backrest 148 and headrest 124; and (v) arm stops 128 which establish a minimum angle between left and right bent arms. A "frame sequence" of this rotation is shown in FIGS. 3-5—also see step S309 of FIG. 1D.

The following parts of base assembly (for the particular example of FIGS. 1A-1B) typically do not rotate and remain stationary while rotating assembly rotates: (i) horizontal 146 and vertical 152 portions of the base; and (ii) horizontal stabilizing element 194.

Figure 1C:
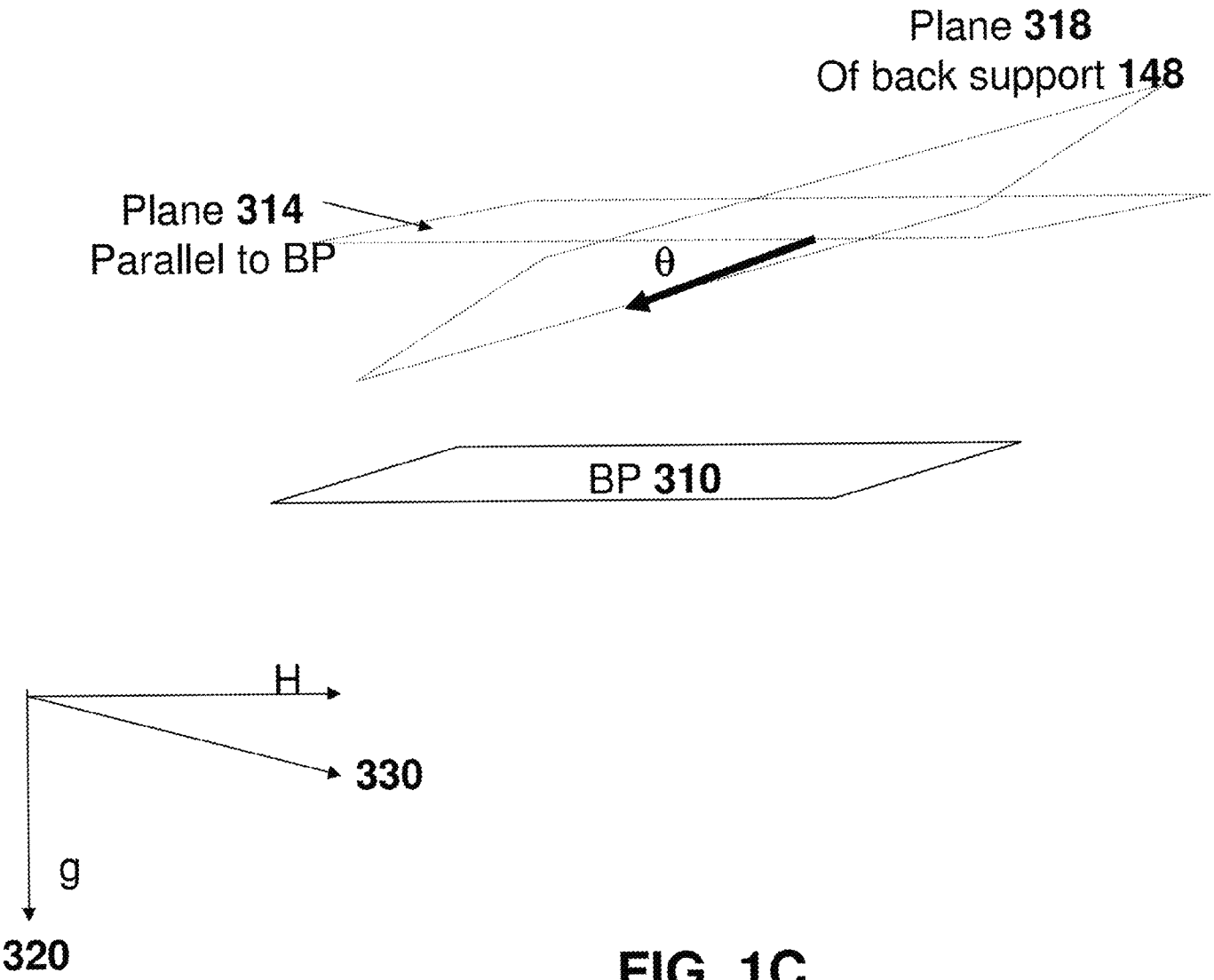
FIG. 1C illustrates a relation between a plane of the back rest and a plane defined by the horizontal/lower element of the base assembly in accordance with some embodiments.
Figure 1D:
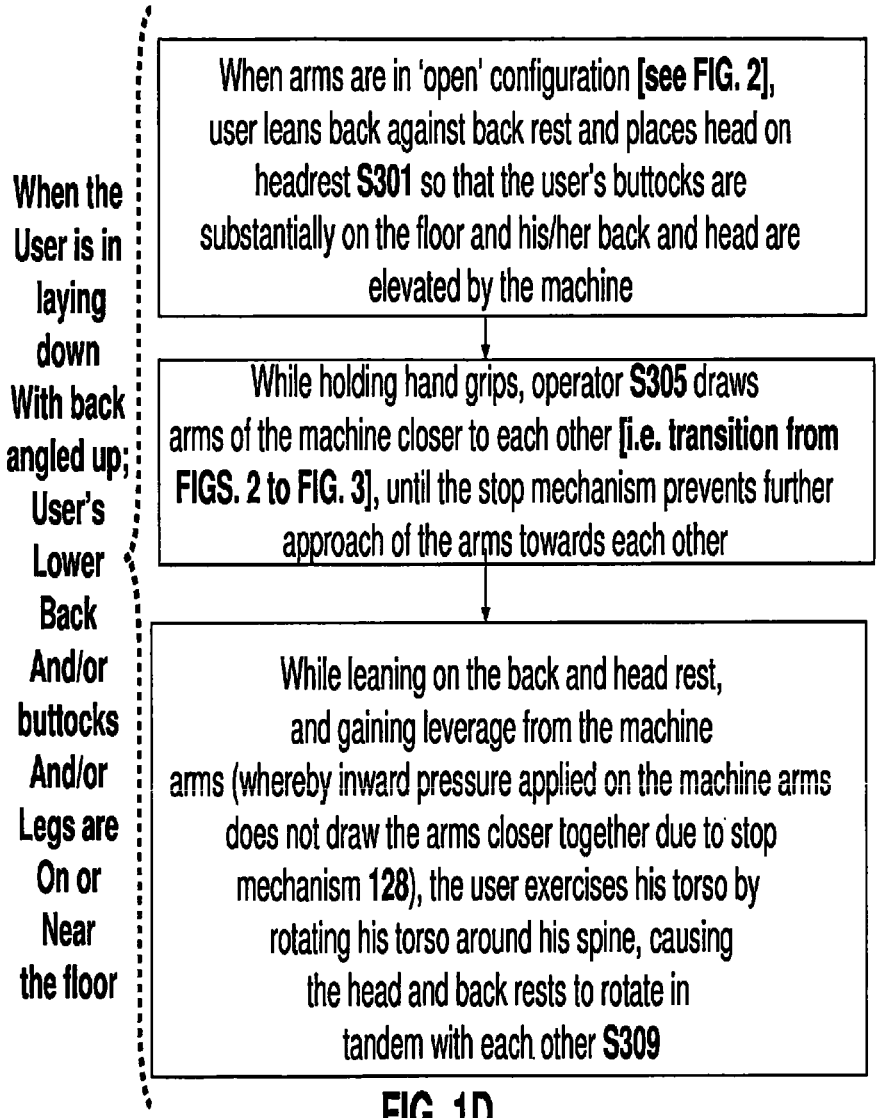
FIG. 1D is a flow chart of a routine for using the exercise machine to effect torso exercises according to some embodiments.
Figure 1E:
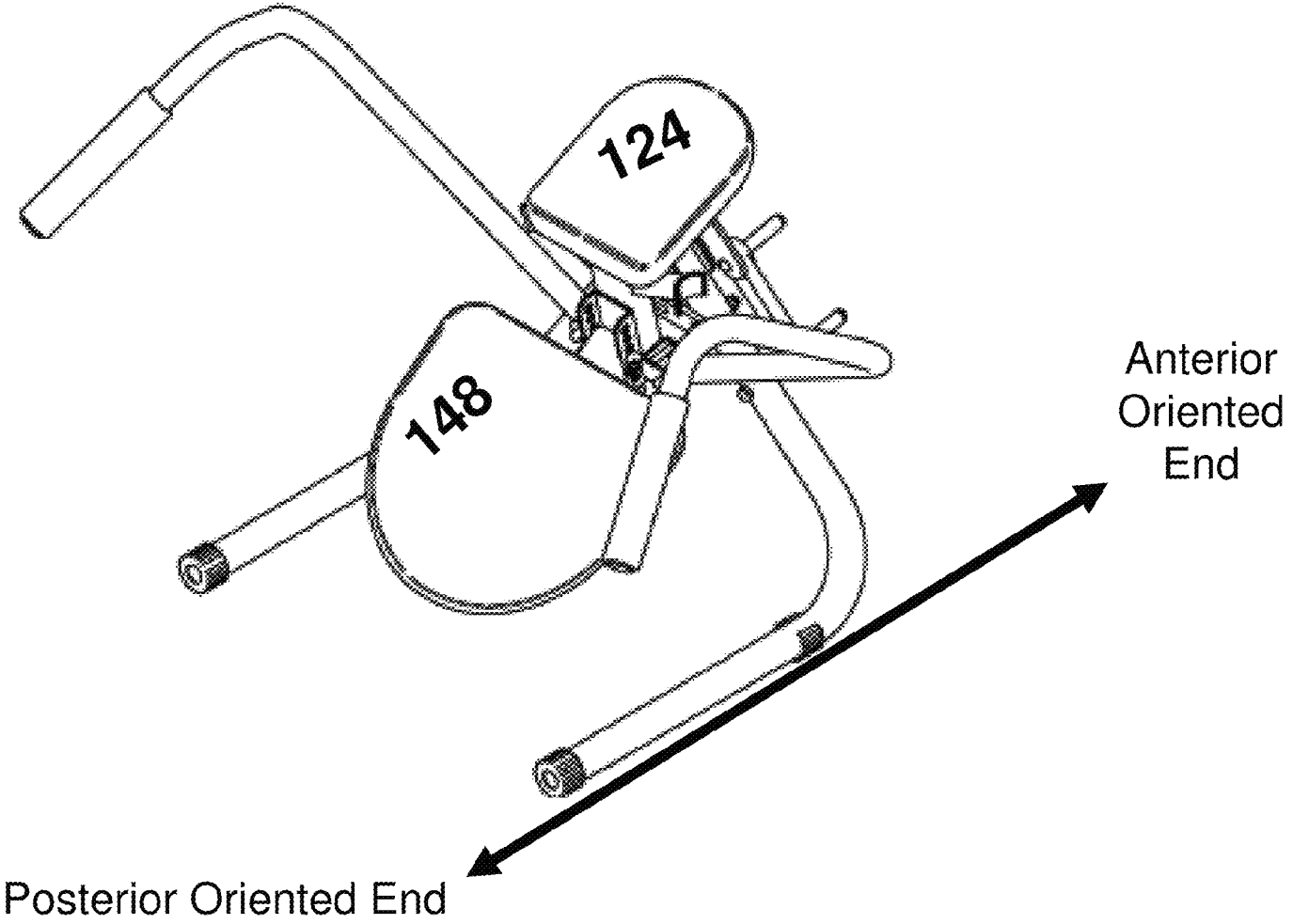
FIG. 1E-1F are additional views of an exercise machine according to some embodiments.
Figure 1F:
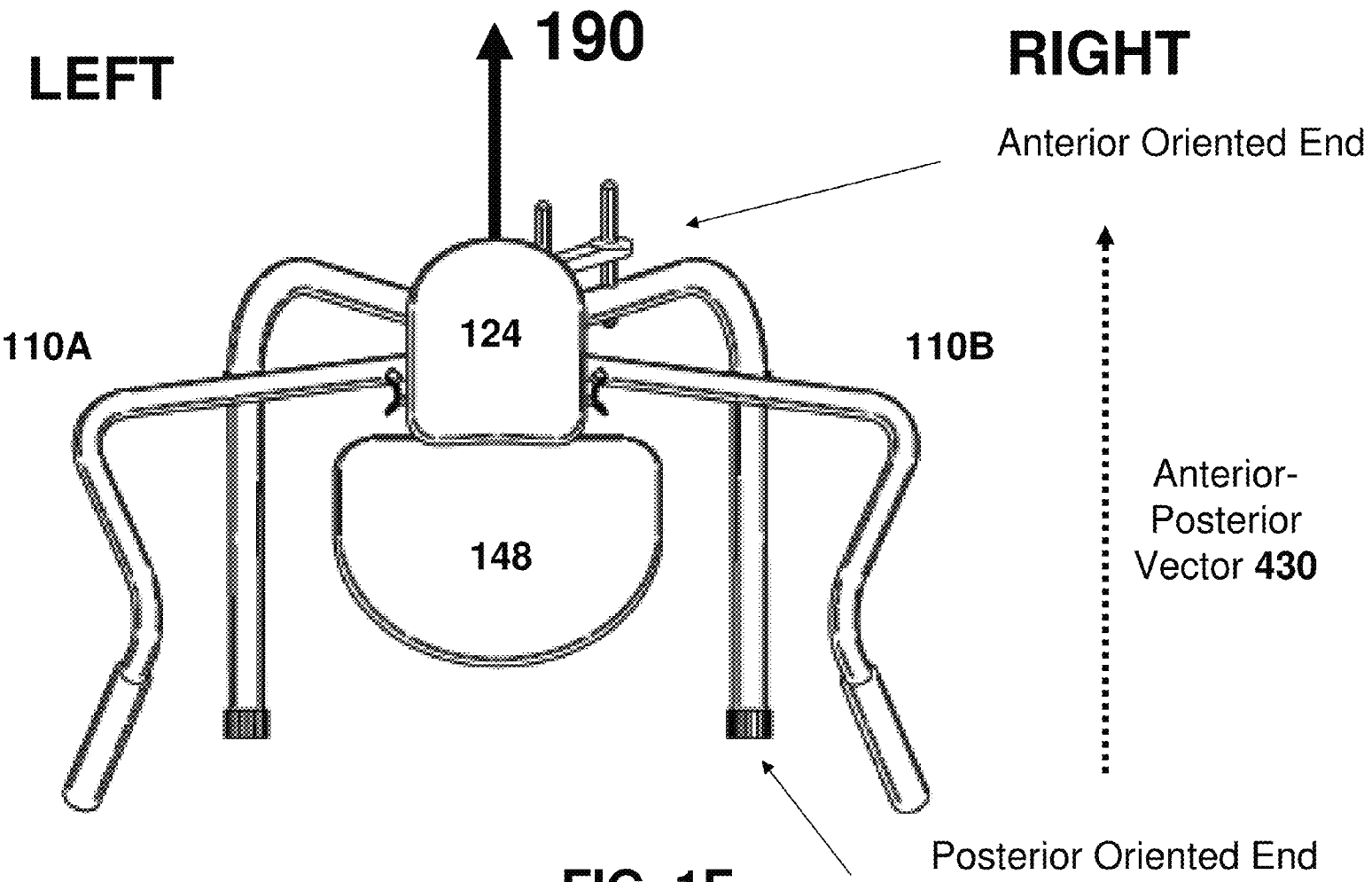

Referring to FIGS. 1E and 1F, one end of the device is referred to as the 'anterior oriented end and the other end of the device is referred to as the 'posterior oriented end The terms 'anterior' and 'posterior' correspond with the anterior and posterior ends of the user when using the exercise device.

Figure 2:
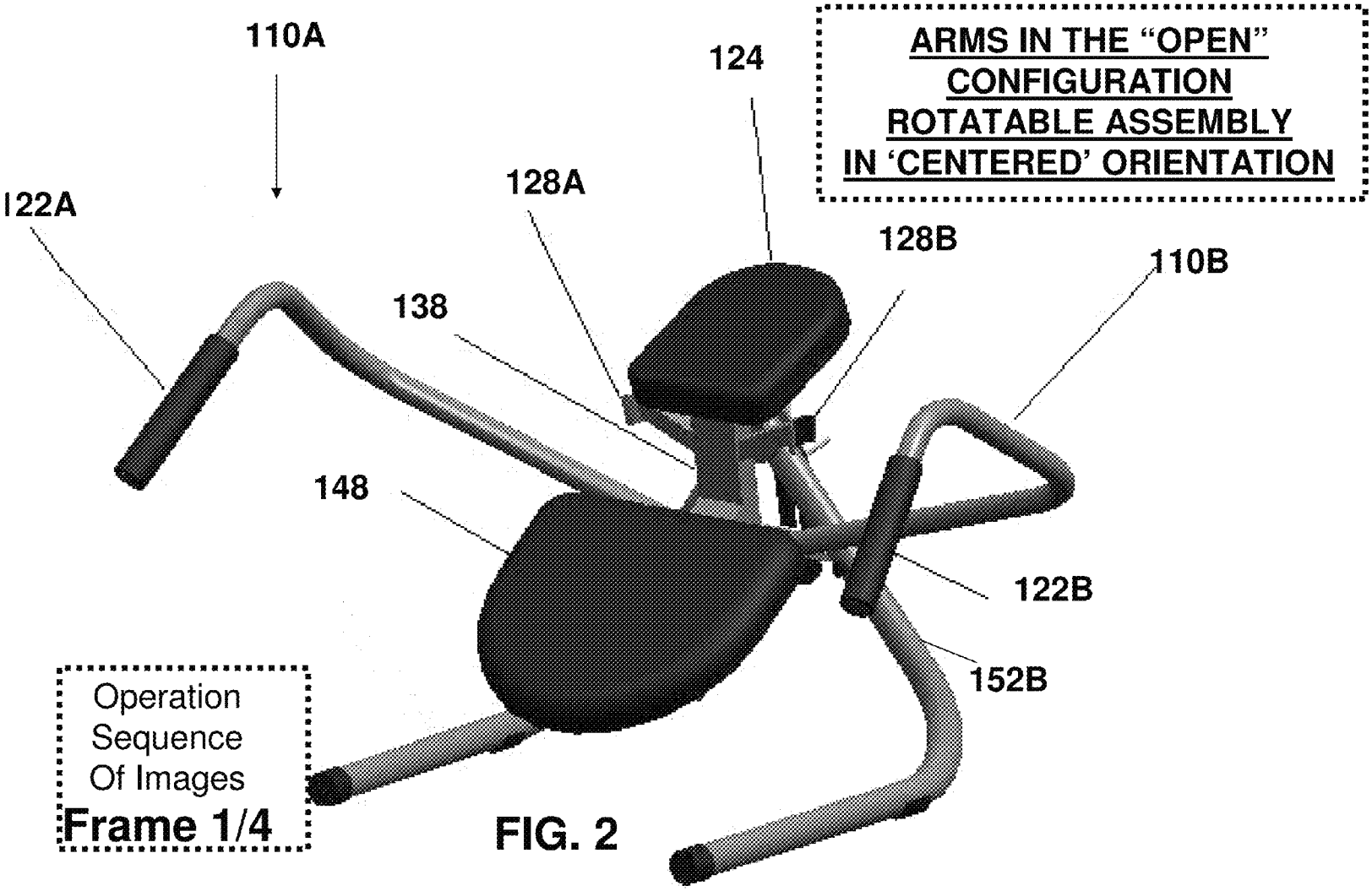
FIGS. 2-5 are frame/image sequence providing diagrams of an exercise machine during a routine where: (i) first the machine's arms are drawn closer together and (ii) then the machine rotates in a direction that is within a vertical plane.

In addition to the aforementioned 'rotational movement' where headrest 124 and backrest 148 rigidly rotate in tandem, the arms of the rotating assembly may be drawn closer together or further apart. A frame sequence of drawing the arms closer together is shown in FIGS. 2-3—also see step S305 of FIG. 2.

Each bent device arm 110 respectively includes: right and left hand grips 122A-B, left and right elongated upward portions and left and right secondary portions 178A, 178B. Left and right secondary portions 178A, 178B are respectively disposed at some acute angle relative to the left and right upward portions. In the illustration of FIGS. 1A-1B, the upward portions 170A, 170B of the two arms form a "right-side-up" V configuration.

The term "upward" refers to the direction from the center of the machine towards the periphery—i.e. movement from the center of the machine towards the periphery along elongated portions 170A, 170B is in an upwards direction away from horizontal base plane. Examples of the "right side-up" or "upwards" V configuration are discussed with reference to FIGS. 14A-14C.

In the non-limiting example of FIGS. 1A-1B, the rods of horizontal base portion 146 and the vertical portion 152 of base assembly are integrally formed—for example, as a single elongated bent rod bent at locations 198A, 198B. In alternative embodiments, the rods (or other parts) of horizontal base portion and vertical portion may be reversibly detachable from each other.

The exercise device illustrated in FIGS. 1A-1B also includes a resistance assembly including: (i) a pair of resistance against rotation of rotating assembly (including both the head and back rest) supporting pegs 192A-192B; and (ii) a rubber band. The resistance assembly provides around rotation axis 190 while the user is rotating his torso to exercise his abdomen muscles—i.e. rotating his torso around an axis substantially parallel to his/her spine. As is illustrated in FIG. 1B, upper peg 192B is attached to the center rotating part 138 through plate 210 and lower peg 194 is attached to the legs of the device through horizontal support element 194.

Figure 9:
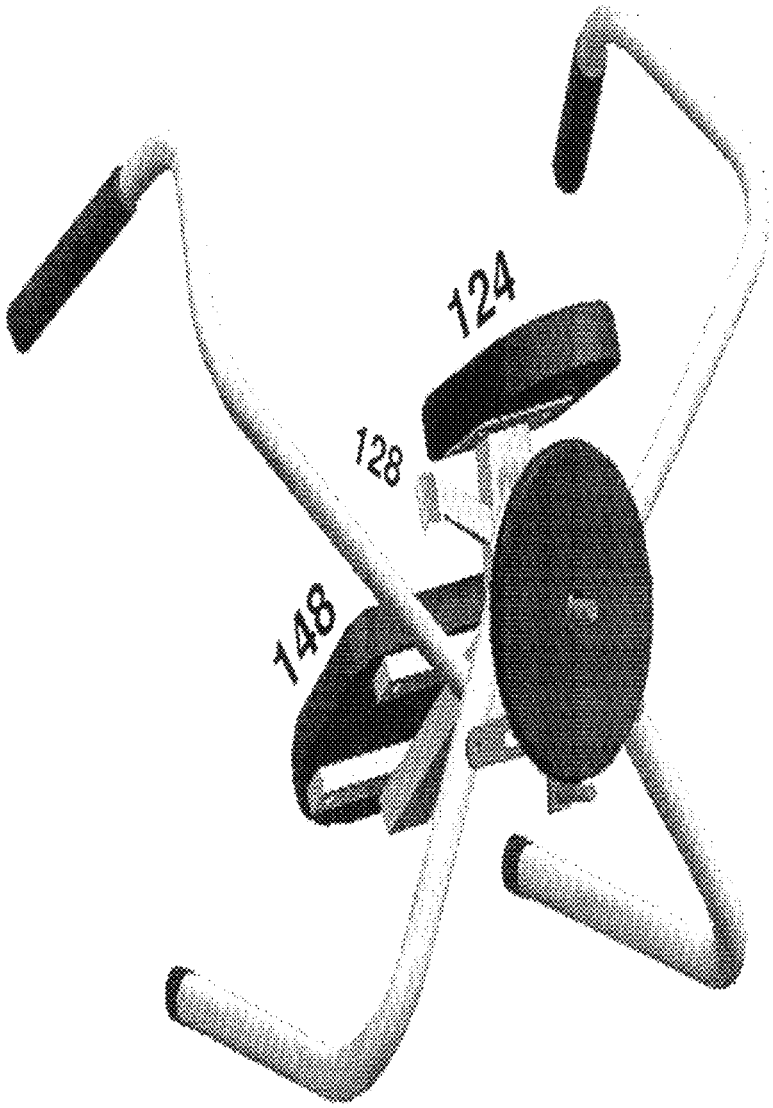
FIG. 9 are a diagram of an machine whereby rotational resistance is provided by a weight.

Thus, the embodiments of FIGS. 1A-1B provide resistance to rotation using a rubber band-type mechanism. Alternatively or additionally, as illustrated in FIG. 9, resistance may be provided using a weight. Although not illustrated in the figures, the skilled artisan will appreciate that other mechanisms for providing resistance to rotation may be used, including but not limited to a spring mechanism and a hydraulic mechanism.

In some embodiments, the upwards or 'middle' or relatively 'centered' orientation of FIG. 3 is the equilibrium orientation—after rotation of the rotating assembly (e.g. including back rest 148) to the left (see FIG. 4) or the right (see FIG. 5), there is a restoring force urging the rotating assembly back towards the equilibrium orientation of FIG. 3. This restoring force (e.g. provided by the rubber band assembly or by counter-torque of a weight assembly or in any other manner) may be the resistance force against side-to-side rotation of the rotating assembly by the user.

In this case, the resistance provided by the resistance assembly to side-to-side rotation is not a constant resistance—instead, this resistance is a variable resistance. For example, this resistance may be a variable resistance that increases of a function of rotational distance from the upwards or 'middle' or relatively 'centered' orientation of rotating assembly Additional elements illustrated in FIG. 1B include: (i) bolt 234 attached to left leg 152A so that right leg 152B may pivot around the bolt 234 when folding (see step S415 of FIG. 6A) (ii) pins 230 which in FIG. 8 may be removed (see step S427) to allow removal of bent arms 110A, 110B thereby making the unit more compact. It is also noted that in step S423 of FIG. 6A that central rotating element 138 may be spun around to make the unit more compact (see FIG. 8).

Although back rest 148 and head rest 124 were illustrated separately in the non-limiting embodiment, it is appreciated that they would be connected together and/or integrally formed and/or part of a larger body support element. For example, the body support element may include only a single an inclined support surface that includes a back rest section (i.e. to provide back rest 148) and a head rest section (i.e. to provide head rest 124).

Thus, it is appreciated that although back rest 148 and head rest 124 are drawn separately, they may be part of a single element. This single element functions at least as a back rest 148 having the upwardly facing and backwards (i.e. in the posterior end 420 direction) back rest surface and optionally also as a head rest 124.

In some embodiments, a centroid of back rest 148 (or of a unified body-supporting rest for both the back and the head) is elevated above the base portion of the base assembly by at least 5 cm or at least 10 cm or at least 15 cm or at least 20 cm or at least 25 cm and/or at most 60 cm or at most 50 cm or at most 40 cm or at most 30 cm or at most 25 cm or at most 20 cm.

A Discussion of FIG. 1C

As illustrated in FIGS. 1A-1B, backrest 148 is angled downwards (i.e. in the direction away from the headrest—this is the direction from the user's head to his/her buttocks)—in various embodiments, the downwards angle of the backrest 148 relative to the 'base plane' defined by base portion 146A, 146B may be between at least 5 degrees—for example, at least 5, 7.5, 10 or 15 degrees. In one non-limiting example, the backrest 148 is fixed at only a single downwards angle. In an alternative example, the downward angle of backrest 148 may be adjusted by the user who can then "lock" or "fix" the downward angle to provide stability to backrest 148 during use.

FIG. 1C illustrates the "base plane" 310 formed by the horizontal/lower portion of the base assembly (element 146A, 146B in FIG. 1A). Typically, the base plane will be at and/or parallel to the floor—i.e. perpendicular to gravity vector 320 and parallel to 'horizontal' vector 330. There are in infinite number of planes parallel to BP 310—one such plane is plane 314.

Furthermore, it is noted that back support 148 will, in some embodiment, substantially define a plane 318. In FIG. 318 it is illustrated that back support is angled down so that the angle between the plane 318 of back support 148 and the plane 314 parallel to BP has a value theta—this angle may be at least 5 degrees—for example, at least 5, 7.5, 10 or 15 degrees.

Operation of the Device for Torso Rotations

In some embodiments, the distance between hand grips 122A and 122B may be fixed.

Alternatively, in order to help provide leverage for the user to allow rotation of the user's torso when his/her head is on rotatable headrest 144 and his/her back is on rotatable backrest 148, the distance between hand grips 122A,122B may be adjustable.

In some embodiments, the machine may be configured so that there is an outward 'bias' to bent arms 110A, 110B—this is referred to as the "open" configuration. When the arms 110A, 110B are located close to each other so that they respectively contact stopping mechanism 128A, 128B (which provides a counterforce that forbids further inward motion of the bent arms 110A, 110B), this is referred to as the "closed configuration.'

In one non-limiting example, a spring (or any other mechanism including but not limited to a rubber band) provides a 'bias' from the close configuration to the open configuration—in this case, when the bent arms 110A, 110B are not held by the user, they nevertheless tend to adopt the 'open' configuration.

Figure 10:
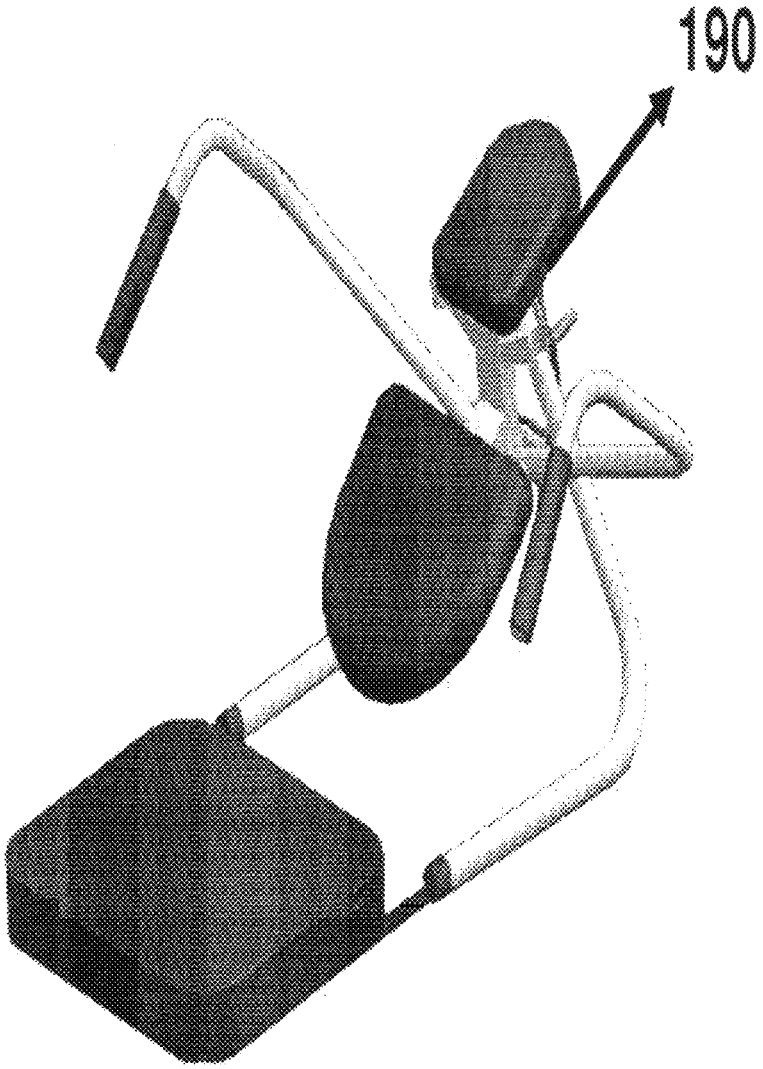
FIG. 10 is a diagram of a machine providing a seat (i.e. for lower back and/or buttocks) that is substantially in a plane device by the horizontal/lower portion of the base assembly.

FIG. 1D is a flowchart of a technique for operating an exercise device in accordance with some embodiments of the present invention. Some or all steps of FIG. 1C may be carried out when the user is in a generally supine position with his/her lower back and/or buttocks and/or legs substantially on the floor. In the examples of most of the figures, the user would most likely place his/her lower back and/or buttocks and/or legs substantially on the floor on the actually floor. In an alternative embodiment (see FIGS. 10-11) a seat may be provided—nevertheless, even in this case, the user's lower back and/or buttocks and/or legs would substantially be on the floor, for example—at a height at this at most 70% or 50% or 30% or 10% the height of the center of back rest 148 and/or the height of the center of head rest 124.

Thus, in step S301 (see FIG. 2), when the arms are in the 'open configuration' user leans back to place his back against the back rest and the head on the head rest. In step S305 (see FIG. 3), the operator/user draws the arms 110A, 110B closer to each other (i.e. the arms are pressed inwardly) so that machine adopts the "closed" configuration. In step 309 (see FIGS. 3-5) the user rotates the rotation assembly including the head and back rest in a "side to side" direction around axis 190, thereby exercising his/her torso. While exercising, the user may continue to press inwardly on arms 110A, 110B—although the arms will not be drawn any closed to each other (i.e. due to stopping mechanism 128A, 128B) this inward motion is useful for providing leverage to the user while rotating rotatable assembly from side to side to exercise his/her torso.

Folding of the Device

Figure 6A:
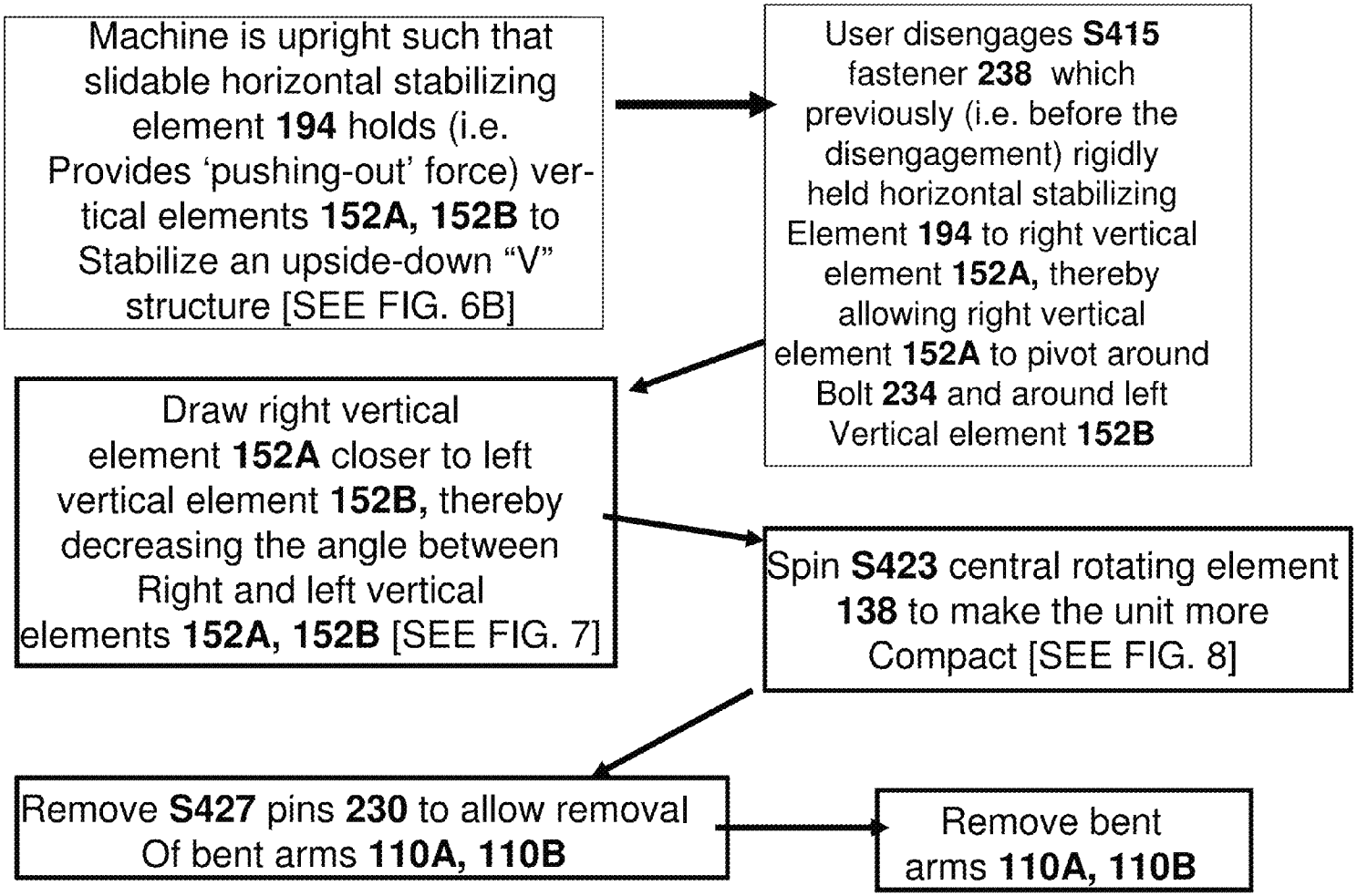
FIG. 6A is a flow chart of a routine for folding an exercise machine in accordance with some embodiments.
Figure 6B:
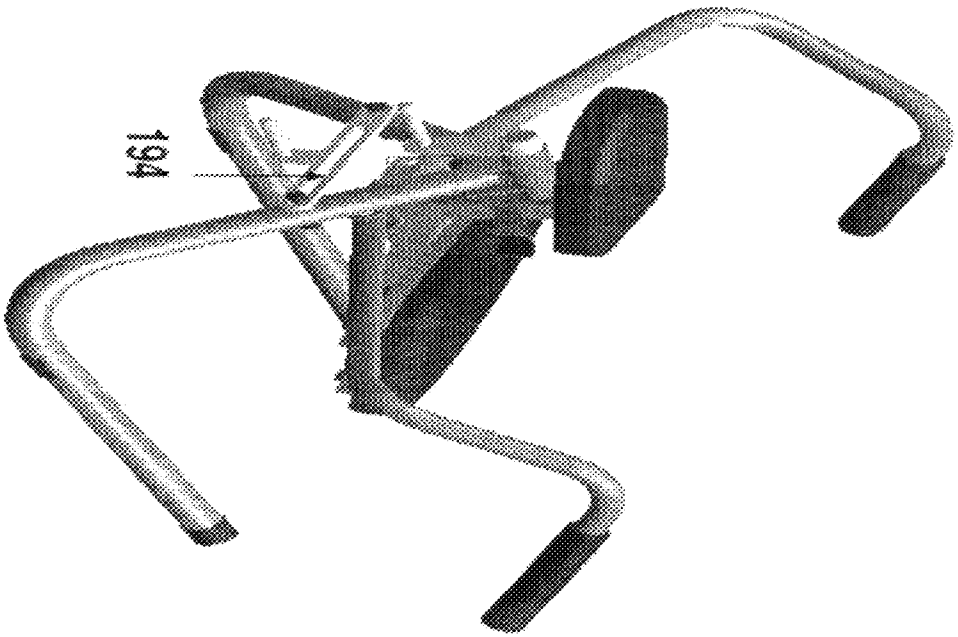
Figure 7:
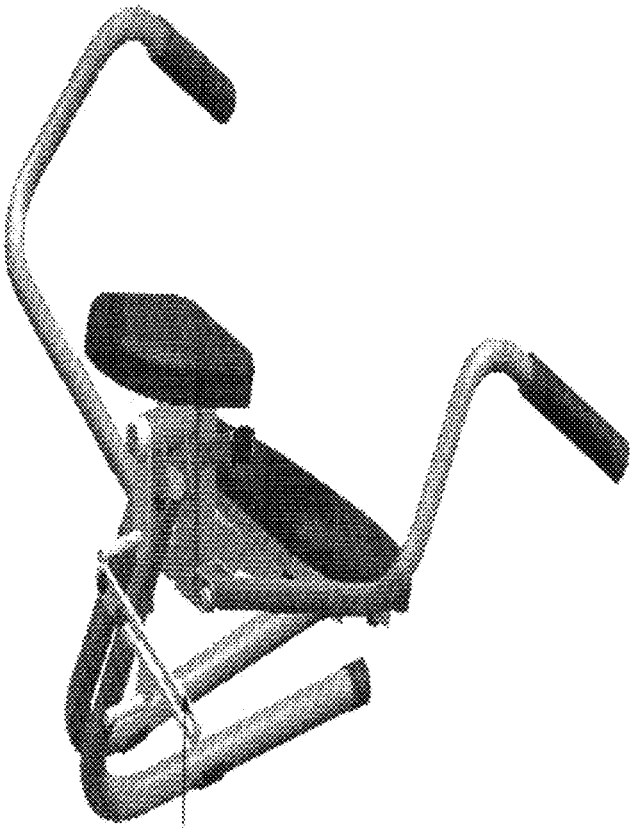
Figure 8:
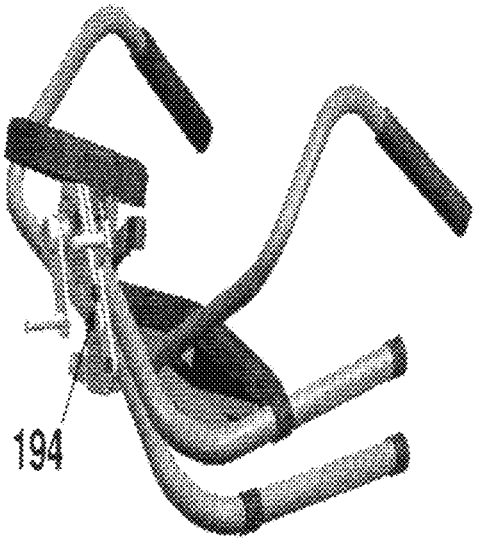

FIG. 6A is a flow chart of an exemplary technique for folding the device in accordance with some embodiments. FIGS. 6B-8 illustrate the device as it gets folded.

Upward V Structure

Figure 14A:
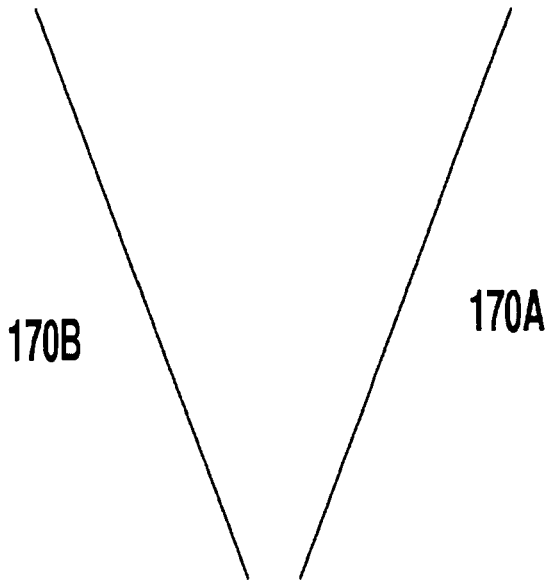
FIG. 14 illustrates V configurations.
Figure 14B:
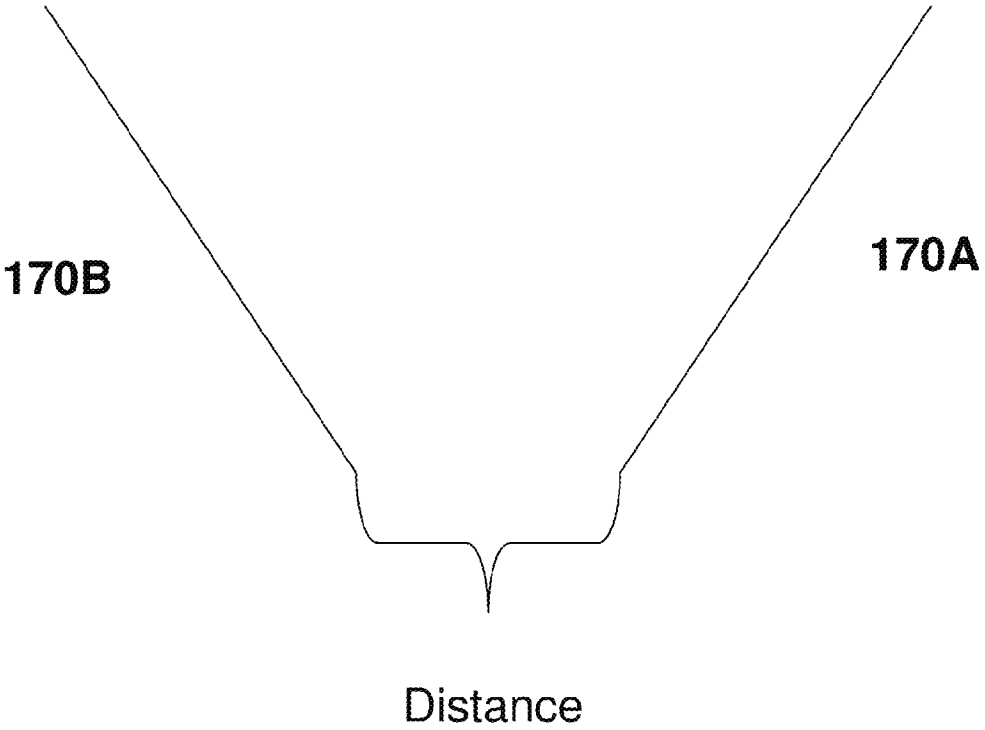

FIGS. 14A-14B illustrate the upwards or "right-side-up" structure, according to various embodiments, that may be formed by elongated upwards portions 170A, 170B of arms 110A, 110B.

Additional Discussion

It is now disclosed for the first time an exercise device comprising:

a) a base assembly including a substantially horizontal base portion defining a base plane and a substantially vertical portion;

b) a rotating assembly configured to rotate in rigid body rotation relative to the rigid base assembly according to a rotation axis that is substantially parallel to the base plane and/or parallel to the anterior-posterior vector 430, the rigid rotating assembly including:

i) an arm assembly including one or more arms (e.g. including left and right bent arms), each bent arm respectively including an elongated upward portion pointing above the base plane to substantially form an upwards V structure; and/or ii) a head rest the upwards or 'middle' or relatively 'centered' orientation 124; and iii) a downwardly-angled back rest 148 below the head rest, the head rest configured at a downward angle that:

A) deviates at least 10 degrees from the horizontal plane perpendicular to the gravity vector and/or at least 10 degrees away from a plane parallel to the base plane defined by the horizontal base portion; and B) in a direction away from the head rest slopes downward.

In some embodiments, the rotating assembly is mounted to the base assembly at a pivot point that is located below the head rest and above at least a portion of the back rest 148 (e.g. above a centroid of back rest 148).

Head and back rest do not need to be provided separately as illustrated in the figures. In some embodiments, they are part of the same surface and/or In some embodiments, the rotating assembly is mounted to the base assembly at a pivot point that is located below the head rest and above the back rest to allow side-to-side rotation of the rotating assembly relative to the rigid base assembly.

In some embodiments, the bent arms are configured to be drawn closer to each other when pressed inwardly.

In some embodiments, the bent are outwardly biased to an extended position.

In some embodiments, the rotating assembly further includes:

iv) left and right arm stops for limiting the extent to which the bent arms may be drawn to each other.

In some embodiments, the substantially vertical portion includes a pair of vertical elongated portions which substantially form an upside-down or downwards V structure.

In some embodiments, a ratio between:

i) a height of a centroid of the headrest above the base plane; and ii) a height of a centroid of the backrest above the base plane is at least 1.5:1.

In some embodiments, the device is foldable so that for the part combination of the head rest, the back rest, and the base assembly, a ratio between:

i) a volume of the part combination when the device is in an operating configuration; and ii) a volume of the part combination when the device is in an operating configuration folded configuration is at least 1.5.

In some embodiments, the ratio is at least 2.

In some embodiments, the ratio is at least 3.

It is now disclosed for the first time a method of effecting a rotary torso exercise by a portable exercise device, the method comprising:

a) at a time that the user is in a generally supine position and that the user's buttocks and/or lower back is located substantially at floor level, placing a user's upper back on a backrest of the exercise device and a user's head on a headrest of the exercise device;

b) drawing left and right rigid arms of the exercise device close to each other so that least a portion of each rigid arm is located above a chest or stomach of the user;

c) rotating in tandem the head rest and the backrest in a direction that is substantially parallel to an elongate axis of the user.

In some embodiments, the drawing is carried out until a stopping mechanism prevents further drawing together of the left and right arms of the exercise device.

Having thus described the foregoing exemplary embodiments it will be apparent to those skilled in the art that various equivalents, alterations, modifications, and improvements thereof are possible without departing from the scope and spirit of the claims as hereafter recited. In particular, different embodiments may include combinations of features other than those described herein.

What is claimed is:

1. An exercise device comprising:

a) a base assembly including a lower base portion defining a base plane and a substantially vertical portion;

b) a rotating assembly configured to effect a side-to-side rigid-body rotation relative to the base assembly around a rotation axis that is substantially parallel to a posterior-anterior vector of the exercise device and around a pivot point that is elevated above the base plane, the rotating assembly including an elevated, inclined back rest or back rest surface that is elevated above the base portion, the back rest surface or an upper surface of the back rest being inclined so as to face in a backwards direction towards a posterior oriented end of the exercise device; and c) a resistance assembly configured to provide resistance to the side-to-side rotation;

d) wherein the rotating assembly further includes a head rest located above the back rest and is configured to effect side-to-side rotation in tandem with the back rest and where the pivot point is above a center of the back rest and below a center of the head rest.

2. The device of claim 1 wherein the device is foldable so that for the combination of the head rest, the back rest, and the base assembly, a volume ratio V1/V2 between:

i) a volume VI occupied by the smallest circumscribing rectangular prism of the combination of the head rest, the back rest and the base assembly when the device is in an operating configuration; and i) a volume V2 occupied by the smallest circumscribing rectangular prism of the combination of the head rest, the back rest and the base assembly when the device is in sa folded configuration is at least 1.5.

3. An exercise device comprising:

a) a base assembly including a lower base portion defining a base plane and a substantially vertical portion;

b) a rotating assembly configured to effect a side-to-side rigid-body rotation relative to the base assembly around a rotation axis that is substantially parallel to a posterior-anterior vector of the exercise device and around a pivot point that is elevated above the base plane, the rotating assembly including an elevated, inclined back rest or back rest surface that is elevated above the base portion, the back rest surface or an upper surface of the back rest being inclined so as to face in a backwards direction towards a posterior oriented end of the exercise device, the rotating assembly being mounted to the base assembly at a pivot point that is located below the head rest and above the back rest; and c) a resistance assembly configured to provide resistance to the side-to-side rotation.

4. An exercise device comprising:

a) a base assembly including a lower base portion defining a base plane and a substantially vertical portion;

b) a rotating assembly configured to effect a side-to-side rigid-body rotation relative to the base assembly around a rotation axis that is substantially parallel to a posterior-anterior vector of the exercise device and around a pivot point that is elevated above the base plane, the rotating assembly including an elevated, inclined back rest or back rest surface that is elevated above the base portion, the back rest surface or an upper surface of the back rest being inclined so as to face in a backwards direction towards a posterior oriented end of the exercise device; and c) a resistance assembly configured to provide resistance to the side-to-side rotation, wherein the substantially vertical portion includes a downwards V portion, wherein the device is foldable to reversibly collapse the downwards V portion.

* * * * *